United States Patent [19]

Dillon

[11] Patent Number: 4,590,925

[45] Date of Patent: May 27, 1986

[54] SYSTEM FOR PROMOTING THE CIRCULATION OF BLOOD

[76] Inventor: Richard S. Dillon, 150 Mill Creek Rd., Ardmore, Pa. 19003

[21] Appl. No.: 526,040

[22] Filed: Aug. 24, 1983

[51] Int. Cl.[4] ..... A61H 9/00

[52] U.S. Cl. ..... 128/24 R; 128/66

[58] Field of Search ..... 128/33, 44, 47, 24 A, 128/66, DIG. 15

[56] References Cited

U.S. PATENT DOCUMENTS

| | | | |
|---|---|---|---|
| 2,747,570 | 5/1956 | Jobst | 128/24 R |
| 3,044,473 | 7/1962 | Cover | 128/66 |
| 3,155,096 | 11/1964 | Outwin | 128/DIG. 15 |
| 3,516,402 | 6/1970 | Toth | 128/66 |
| 3,757,806 | 9/1973 | Bhaskar | 128/66 |
| 3,961,625 | 6/1976 | Dillon | 128/40 |
| 4,101,988 | 7/1978 | Sierant | 128/66 |
| 4,269,175 | 5/1981 | Dillon | 128/24 R |
| 4,320,746 | 3/1982 | Arkans | 128/24 R |
| 4,343,302 | 8/1982 | Dillon | 128/24 R |

FOREIGN PATENT DOCUMENTS

| | | | |
|---|---|---|---|
| 2161925 | 5/1973 | Fed. Rep. of Germany | 128/66 |
| 2460892 | 10/1976 | Fed. Rep. of Germany | 128/66 |
| 2613 | of 1908 | United Kingdom | 128/66 |

OTHER PUBLICATIONS

"An End-Diastolic Air Compression Boot for Circulation Augmentation", Richard S. Dillon, M.D., Journal of Clinical Engineering, vol. 5, No. 1, Jan.-Mar. 1980.

*Primary Examiner*—Clyde I. Coughenour

*Attorney, Agent, or Firm*—Dann, Dorfman, Herrell & Skillman

[57] ABSTRACT

A system is provided for promoting the circulation of blood through a patient's extremity. An outer retaining garment confines and constrains an inflatable air bag around the patient's extremity that is undergoing treatment. Compressed gas is supplied to and exhausted from the air bag to inflate and deflate the air bag in order to provide compression and decompression of the patient's extremity. Flow passages in the air bag extend from the gas inlet to selected distribution points within the air bag to provide uniform inflation of the air bag substantially simultaneously throughout its length. The rate of compression and decompression of the patient's extremity is controlled and phased to the patient's heart beat in order to promote the circulation of blood through the extremity.

18 Claims, 5 Drawing Figures

SYSTEM FOR PROMOTING THE CIRCULATION OF BLOOD

FIELD OF THE INVENTION

The present invention relates to a system for improving the circulation of blood and more particularly to a system for improving the circulation of blood through a patient's extremity.

BACKGROUND OF THE INVENTION

For the treatment of various diseases, it is often helpful to enhance the patient's natural blood circulation. It is particularly desirable to promote blood circulation in the treatment of various ischemic diseases which occur in the extremities or limbs of the body. By artificially promoting blood circulation, the development of ischemic lesions on a patient's extremities can be curtailed and in fact even small gangrenous lesions may be healed or arrested.

To artificially enhance the patient's natural blood flow through an extremity, devices have been utilized which apply and remove pressure from at least a portion of the patient's extremity. For example, the patient's extremity can be enclosed in an air bladder or air bag which can be inflated to apply pressure on the extremity and deflated to remove pressure from the extremity. Through the application of pressure, blood can be forced into the extremity.

In order to function properly, expansion of the air bag must be restricted or controlled so the application of pressure on the extremity can be controlled.

As set forth in my earlier U.S. Pat. Nos. 3,961,625, 4,269,175 and 4,343,362, it is desirable to restrict the volume of expansion of the air bag as much as possible while still enabling unrestricted controlled fluid flow through the air bag, to control the compression and decompression of the patient's extremity, and to this end a rigid retaining means structure was preferred to enclose the air bag. Since the rigid structure was not convenient in all cases, it was suggested that a flexible outer retaining garment be used to control the air bag.

The restriction of air flow through the air bag may be a problem when a rigid outer retaining structure is employed to confine the air bag in close proximity aroung the patient's extremity. However, the problem becomes magnified when a flexible outer retaining garment is employed. The efficiency of the system was decreased when using a flexible outer retaining garment because application of pressure to the extremity is delayed until after the air bag fully distends the flexible outer retaining garment, and if the flexible outer retaining garment is adapted to closely constrain the air bag in an attempt to improve efficiency, fluid flow through the air bag becomes greatly restricted and obstructed.

SUMMARY OF THE INVENTION

The present invention provides a system for prompting the circulation of blood through a patient's extremity in a highly efficient manner. In accordance with the present invention, the system carefully controls the application of pressure to a patient's extremity through the use of an inflatable enclosure which can be closely confined and retained around the patient's extremity while enabling generally unrestricted controlled fluid flow, preferably gaseous fluid, through the enclosure.

In accordance with an embodiment of Applicant's invention, an inflatable enclosure having resilient flexible walls is provided for covering at least that portion of a patient's extremity which is to be treated. The inflatable enclosure includes fluid inlet means for receiving a fluid flow to inflate the enclosure. Retaining means is employed to confine the enclosure along its outer surfaces so that when the enclosure is inflated it will apply controlled pressure to the patient's extremity. The system also includes guide means that is engageable with the outer surface of the resilient flexible walls of the enclosure to deform the outer wall of the inflatable enclosure in a predetermined manner as the enclosure inflates so as to form channel means for the fluid within the inflatable enclosure. The channel means provides flow passages in the enclosure extending from the fluid inlet means to selected distribution points within the enclosure. The flow passages enable uniform inflation of the enclosure substantially simultaneously throughout the length of the enclosure even when the enclosure is tightly constrained to a patient's extremity. To exhaust fluid from the enclosure in order to reduce pressure on the extremity, fluid outlet means is provided. In a preferred embodiment, a fluid access port is provided in the inflatable enclosure which cooperates with supply and exhaust means to function as both the fluid inlet means and the fluid outlet means. The supply and exhaust means controls the inflation and deflation of the enclosure to selectively apply and remove pressure on a patient's extremity in a desired sequence without any substantial restriction or obstruction of the fluid flow through the enclosure.

BRIEF DESCRIPTION OF THE DRAWINGS

The foregoing summary as well as the following detailed description of preferred embodiments of the present invention will be better understood when read in conjunction with the appended drawings in which.

DETAILED DESCRIPTION OF THE INVENTION

Figure 1:
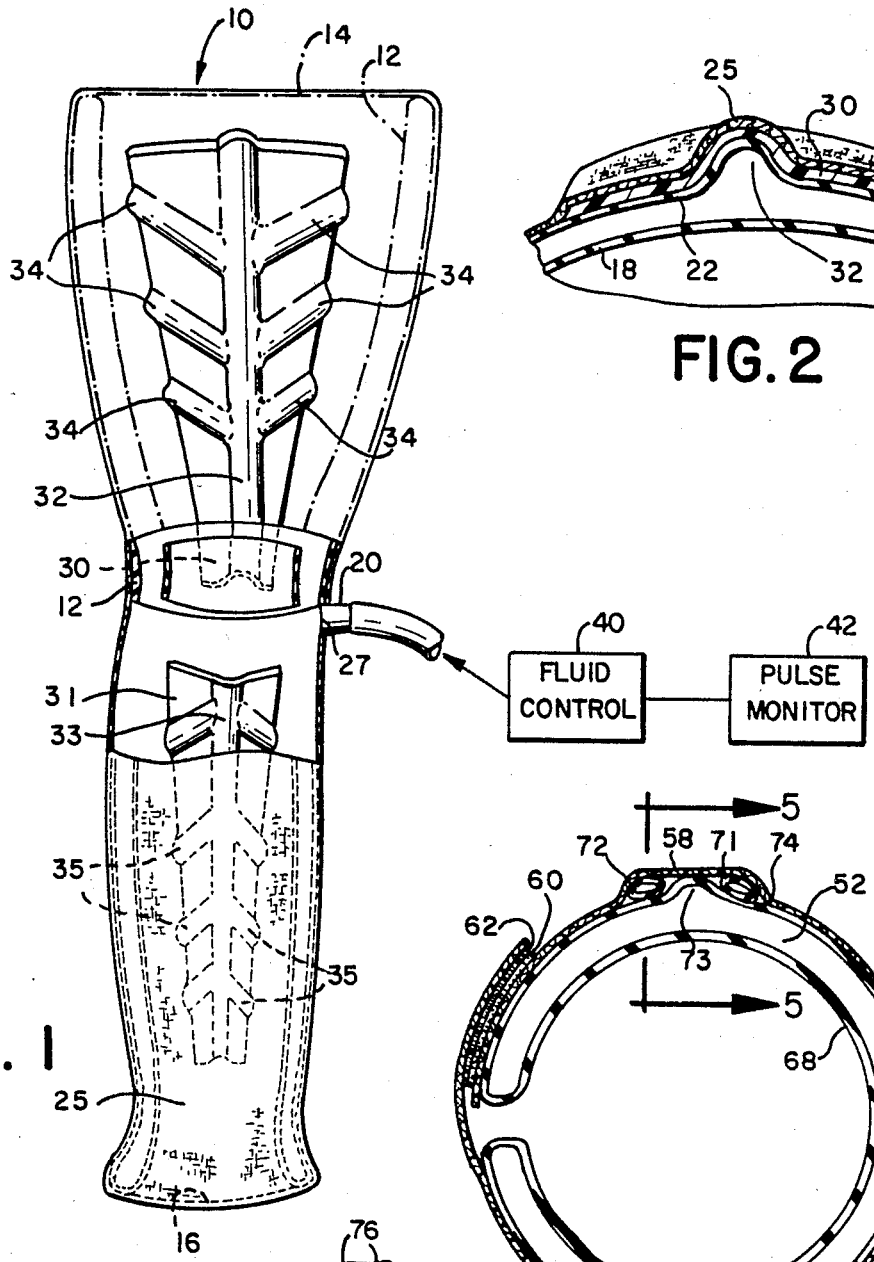
FIG. 1 is a rear elevational view, with upper portions partially cut away, illustrating the system for promoting the circulation of blood in accordance with a preferred embodiment of the present invention employing a retaining structure with rigid guide means.
Figure 2:
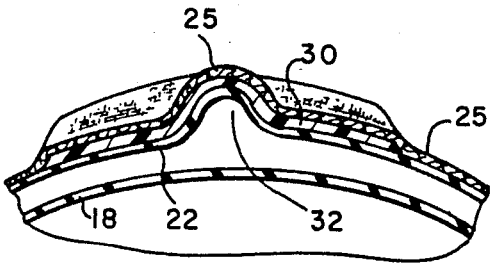
FIG. 2 is an enlarged fragmentary transverse sectional view taken through the upper portion of the system illustrated in FIG. 1.

Referring to the drawings and initially to FIGS. 1 and 2, a system, generally designated 10 for promoting the circulation of blood through a patient's extremity is illustrated. To treat the extremity the circulation of blood is artificially enhanced by the compression and decompression of the extremity through the controlled application and removal of pressure on the extremity. For this purpose, an inflatable enclosure having resilient flexible walls is provided for covering at least a portion of the patient's extremity to be treated. The inflatable enclosure is then inflated and deflated to apply controlled external pressure on the extremity.

Where a patient's leg is to be treated, for example, the inflatable enclosure, as specifically illustrated in FIG. 1, is in the form of an inflatable plastic bag-type tubular legging 12 having open ends 14 and 16 at its opposite ends. The body of the legging is hollow with spaced parallel inner and outer walls 18 and 22, and defines a central passageway extending therethrough so that the legging can be easily slipped over the patient's leg. In position, the illustrated legging extends from the upper thigh down to the ankle, and upon inflation of the legging, the inner wall 18 of the inflatable legging will closely confront and conform to the shape of the patient's leg. The material of the legging is sufficiently resilient to fit over the leg of any one of a number of patients.

The legging 12 is inflated and deflated with inflating fluid, preferably compressed air or other gas, which is introduced to and removed from the hollow body through a fluid access port in the form of an inflation nipple 20 integral with the outer wall 22 of the inflatable legging 12. The inflation nipple is located approximately midway between the respective ends of the legging so that it may be positioned at approximately knee level and to one side of the patient's knee when the legging is slipped over the patient's leg. Although separate fluid inlet and outlet means may be provided on the legging for introduction and removal of compressed air, in the embodiment illustrated in FIG. 1, the inflation nipple 20 functions both to receive and to expel the compressed gas.

So that the inflation and deflation of the inflatable legging 12 properly compresses and decompresses the patient's leg during treatment, retaining means is employed to confine and constrain the inflatable legging 12 in position surrounding and enclosing the patient's leg. To this end, a flexible outer retaining garment 25 in the form of a generally leg-shaped canvas sheath is employed which can be fitted over the exterior of the inflatable legging so as to closely confront and confine the outer wall 22 of the legging 12 as the legging inflates. The canvas garment 25 completely covers the exterior of the inflatable legging and extends from the patient's upper thigh down to the ankle. The outer retaining garment 25 includes a nipple receiving aperture 27 located approximately midway between the opposite ends of the garment so that the nipple 20 of the inflatable legging 12 can be inserted therethrough prior to placing the unit on the patient's leg. It is desirable for the inflatable plastic legging 12 to be separate from the outer retaining garment 25 so that the inflatable plastic legging can be discarded after treatment and a fresh one used for each new patient, preserving the garment 25 for repeated use.

To increase control over the rate of compression and decompression of the leg, it is desirable to limit the available free space for the inflation of the legging 12 as much as possible. This can be accomplished by closely retaining the legging to the patient's leg. However, if the inflatable legging 12 is too tightly constrained by the outer retaining garment 25, it is difficult to obtain rapid and uniform inflation and deflation of the legging throughout its outer length.

The present invention provides means to promote substantially unobstructed gas flow through the legging. In the embodiment of FIGS. 1 and 2, guide plates 30 and 31 engage the outer surface of the inflatable legging and are effective to deform the outer wall 22 of the inflatable legging in a predetermined manner when the legging inflates so as to form channel means within the hollow body of the legging to provide flow passages for the compressed gas. For this purpose, the wall deforming plates 30 and 31 each have an inner surface which is generally contoured in the shape of a leg for confronting the exterior outer wall 22 of the inflatable legging as it inflates. The inner surface of plate 30 is provided with a longitudinal groove 32 which extends from one end of the plate to the other. A number of branch grooves 34 extend generally transversely from the longitudinal groove 32 to the opposite edges of the plate. Likewise, plate 31 includes longitudinal groove 33 having generally transverse branch grooves 35.

The wall deforming plates 30 and 31 are mounted on the interior of the outer retaining garment 25 in desired positions. As illustrted in FIG. 1, plate 30 is positioned facing the front of the thigh so that it overlies the course of the great vessels in the thigh and so that the longitudinal groove 32 courses from the upper thigh down to the knee terminating in the general proximity of the source of the gas supply at the nipple 20. Similarly, plate 31 is positioned facing the back of the calf of the leg so that the longitudinal groove courses from the upper calf in the proximity of the gas supply at the nipple 20 down to the back of the ankle.

As best illustrated in FIG. 2, the grooved contoured inner surface of guide plate 30 engages the outer surface of the outer wall 22 of the inflatable legging as it inflates. The air pressure in the body of the legging causes the ouer wall 22 of the legging to deform into the groove 32 as the legging inflates thereby forming channel means within the legging to provide flow passages for the compressed gas extending from the supply of gas at nipple 20 to remote distribution points within the legging. The channels formed in the longitudinal grooves of the plates respectively direct the gas from the gas inlet at the knee generally upwardly to the top of the thigh and generally downwardly to the ankle. The channels formed in the branch grooves 34 and 35 of the respective plates function to start the movement of compressed gas in both transverse directions generally circumferentially around the leg. As a result, a substantially unobstructed flow path is provided for the compressed gas along the leg while affording the outer retaining garment to be closely fitted to the leg.

A fluid control system 40 functions to supply and exhaust compressed gas to and from the inflatable legging in order to compress and decompress the patient's leg to promote the circulation of blood. The fluid control system can supply and exhaust compressed gas to and from the inflatable legging in any known manner, but it is preferable to use the system disclosed and claimed in my prior U.S. Pat. No. 4,343,302 issued on Aug. 10, 1982. The entire disclosure of this patent is incorporated herein by reference, but briefly summarized, the system uses a pulse monitor 42 to control the fluid control system 40 so that the compression and decompression of the patient's leg is phased to the patient's heart beat. The QRS complex is detected by the pulse monitor indicating the initiation of a heart beat. An adjustable delay interval is provided to allow the pulse of blood to travel from the heart to the leg. During this delay interval, an exhaust outlet of the fluid control system 40 remains open to vent pressurized gas from the inflatable legging through nipple 20. At the conclusion of the delay interval, the exhaust outlet is closed and an air inlet is opened to supply pressurized air to the inflatable legging through nipple 20. The inflatable legging remains pressurized until either the next QRS complex is detected or for a selected adjustable time interval that elapses prior to the next QRS complex. In this manner, compression of the leg forces the flow of blood into the leg while not obstructing the natural blood pulses to the leg.

The material of the inflatable enclosure 12 is preferably sufficiently deformable to form the channels immediately upon application of internal pressure by the compressed gas. The elasticity of the air bag material permits the rapid deformation of the outer wall 22. It should be noted that the material of the enclosure 12 need not be elastic, if it is for one-time usage. In such case it needs only to be deformable upon application of pressure. In either event, the end portions at 14 and 16 should be made resistant to deformation or be confined by the retaining garment 25 to limit the longitudinal expansion of the enclosure beyond the ends of the garment.

Figure 4:
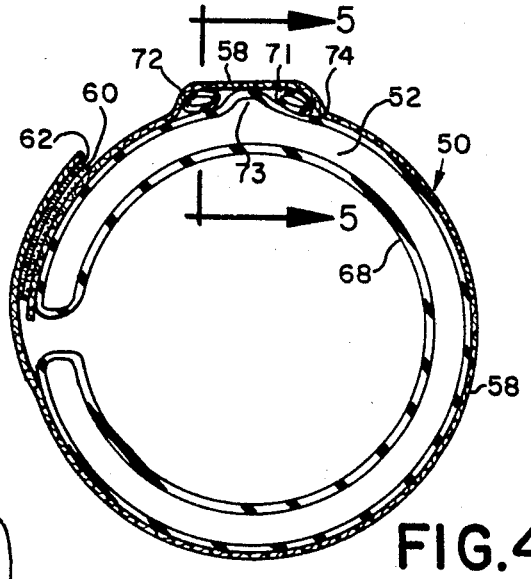
FIG. 4 is an enlarged transverse cross sectional view of the structure illustrated in FIG. 3 in a fully-wrapped arrangement in use in the system.
Figure 5:
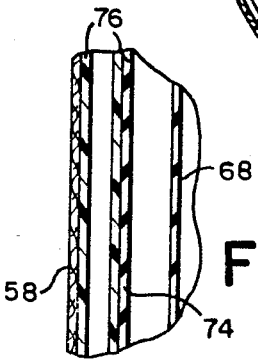
FIG. 5 is a fragmentary cross sectional view taken along line 5—5 of FIG. 4.
Figure 3:
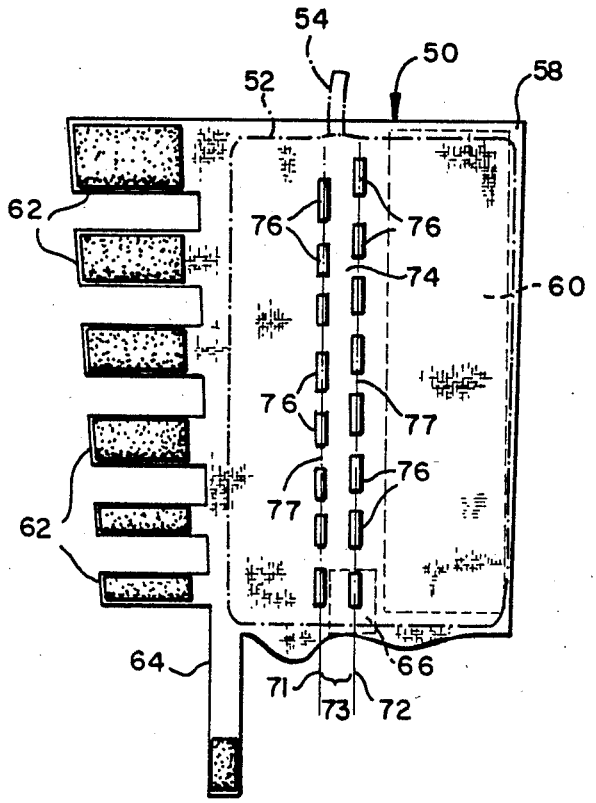
FIG. 3 is a plan view of a retaining structure with flexible guide means for use in another preferred embodiment of the present invention.

Referring to FIGS. 3, 4 and 5, another preferred embodiment of the present invention is illustrated which functions in generally the same manner as the embodiment previously illustrated and described in reference to FIGS. 1 and 2. Instead of using an inflatable legging which slips over the leg, an inflatable wrap-around cuff generally designated 50 is employed. As illustrated in FIG. 3 in fully opened position, the cuff 50 is designed to wrap around the patient's extremity where it can be secured in place. Where the patient's leg is to be treated the cuff is wrapped around the calf of the leg and extends from the knee to the ankle. To apply pressure to the patient's extremity, the cuff includes an inflatable air bag 52 having a fluid access port in the form of a nipple 54. In the present embodiment the air bag 52 has spaced parallel inner and outer walls 68 and 74 respectively forming a flat hollow structure which is slightly smaller than the cuff 50, and may be fastened with the inner wall 68 exposed and the outer wall 74 engaging the inner surface of a canvas outer retaining garment 58. The outer retaining garment 58 includes a fastening pad 60 and complementary fastening straps 62 so that as the cuff 50 is wrapped around the patient's extremity, the straps securely fasten to pad 60 to hold the cuff 50 firmly in position, as best illustrated in FIG. 4. Preferably the pad and straps comprise hook-and-loop type releasable fastening material, generally available under the VELCRO ® trademark, but other types of reusable fastening devices may be used. To securely fasten the cuff to a patient's leg, a foot strap 64 is provided at the bottom of the outer retaining garment. The foot strap wraps underneath the instep of the patient's foot and securely fastens to a pad 66 located at the bottom of the outer retaining garment, for example with complementary VELCRO ® fastening materials.

Once the cuff is securely wrapped and fastened around the patient's leg, compressed gas is supplied to and exhausted from the air bag through nipple 54. As compressed gas enters the air bag causing it to inflate, the inner wall 68 closely confronts and conforms to the shape of the patient's leg so that the introduction and removal of compressed gas from the air bag 52 causes the desired compression and decompression of the leg. To provide unobstructed air flow through the air bag, when the cuff is tightly secured to the patient's leg, air passages are formed in the air bag. To this end, tubing elements 76 are mounted in parallel rows 71 and 72 to the inner surface of the outer retaining garment 58 to engage the outer wall 74 of the air bag 52. The rows 71 and 72 are spaced apart to define a narrow passageway 73 therebetween. Once the cuff is secured to the patient's leg, the passageway 73 overlies the calf of the leg and extends along the outer surface of the outer wall 74 of the air bag from the air inlet 54 at the top of the cuff near the patient's knee down to the bottom of the cuff in the vicinity of the patient's ankle. As best illustrated in FIG. 4, as the air bag 52 inflates, the parallel rows of tubing comprise guide means slightly deforming the outer wall 74 of the air bag causing the outer wall 74 to expand into the passageway 73 defined between the parallel rows of tubular elements. As the outer wall 74 deforms into the passageway, a longitudinal channel is formed between the rows but within the air bag along outer wall 74. The channel provides a substantially unobstructed flow passage for the compressed gas. The parallel rows of tubular elements thereby provide a longitudinal flow passage for the compressed air extending from the air inlet at the top of the cuff down to the bottom of the cuff.

To permit transverse gas flow generally circumferentially of the leg, each of the parallel rows comprises a series of the tubular elements 76, as illustrated in FIG. 3, which are spaced apart so as to form gaps 77 along the parallel rows. The gaps between the tubular members provide passageways transverse to the passageway 73, permitting formation of lateral channels in the outer wall 74, affording transverse gas flow as the air bag inflates so that some gas flow is directed circumferentially about the leg. By staggering the arrangement of the tubular members in one row with respect to the tubular members of the other row, the transverse gas flow is enhanced. By providing the flow passages in the air bag, more uniform and simultaneous inflation of the air bag is achieved.

By the use of the guide means of the preferred embodiments of the present invention, the retaining structure may comprise a flexible structure of fabric or other sheet material which conforms closely to the contour of the body extremity to which it is applied. Of course, a rigid retaining structure of the type shown in my U.S. Pat. No. 3,961,625 may also be used with the inflatable enclosure of the present invention and the enclosure may extend beyond the structure to increase the treatment area. In this case the inflatable structure has a fluid connection to the gas inlet line of the structure. The retaining structure confines the air bag or other inflatable enclosure to assure immediate application of pressure to the extremity upon application of compressed gas thereto. The guide means provides an economical and efficient means to provide distribution channels in the interior of the inflatable enclosure by the simple and effective procedure of deforming one of the walls of the enclosure temporarily during the application of air pressure.

While certain preferred embodiments of the present invention have been illustrated and described, the present invention is not limited thereto. For example the guide means may be mounted on the inflatable enclosure either during its assembly with the retaining structure or during its fabrication. The guide means may also be mounted internally of the enclosure, either as an attachment to it or as an integral part of it, and may cooperate with the inner wall rather than the outer wall to provide channels adjacent to the treated extremity. Other modifications may be made by one skilled in the art within the scope of the following claims.

I claim:

1. An apparatus for promoting circulation of blood through an extremity comprising:

(A) an inflatable enclosure having a resilient flexible wall for covering at least a portion of the extremity and a deformable outer wall;

(B) fluid supply means for the enclosure for supplying a fluid flow to the enclosure to inflate the enclosure;

(C) retaining means for the enclosure outer wall for retaining the enclosure so that inflation of the enclosure applies pressure on the covered portion extremity;

(D) guide means positioned externally of the enclosure for confronting the outer surface of the outer wall of the enclosure cooperable with the fluid means to cause, during inflation of the enclosure, the outer wall to deform in a predetermined manner to form channel means internally of the enclosure throughout its length providing flow passages in the enclosure extending from the fluid supply means to selected distribution points within the enclosure to enable inflation of the enclosure substantially simultaneously throughout its length;

(E) exhaust means for said enclosure for exhausting fluid from the enclosure to reduce pressure on the extremity; and (F) control means for the fluid supply means and the exhaust means for controlling the application of pressure on the extremity in a predetermined manner.

2. The apparatus as recited in claim 1 wherein said retaining means is positioned externally of the enclosure at least partially enclosing said inflatable enclosure and said guide means is positioned intermediate the retaining means and the inflatable enclosure.

3. The apparatus as recited in claim 1 wherein said guide means includes projecting means with a recessed passageway engageable with the outer surface of said outer wall of the inflatable enclosure, said outer wall of said inflatable enclosure being deformed into said recessed passageway by fluid pressure in said inflatable enclosure from said fluid supply means to form said channel means.

4. The apparatus as recited in claim 3 wherein said projecting means comprises elements supported on the retaining means in parallel rows, said channel means being formed within said enclosure between said parallel rows when said enclosure inflates.

5. The apparatus as recited in claim 1 wherein said guide means has a surface confronting said outer wall, said surface having at least one passage-defining groove, said outer wall being deformed into the groove to form said channel means by fluid pressure in said inflatable enclosure from said fluid supply means.

6. The apparatus as recited in claim 1 wherein said inflatable enclosure includes a fluid access port connected to said fluid supply means and said exhaust means, and said apparatus including valve means to regulate the fluid flow to and from said inflatable enclosure.

7. An apparatus for promoting circulation of blood through an extremity comprising:

(A) an inflatable enclosure having a resilient flexible inner wall for covering at least a portion of the extremity, and an outer deformable wall;

(B) fluid inlet means and fluid outlet means in said enclosure for receiving a fluid flow to inflate the enclosure, and for exhausting fluid from the enclosure;

(C) retaining means for the enclosure outer wall for retaining the enclosure so that inflation of the enclosure applies pressure on the extremity and exhaustion of the fluid reduces pressure on the extremity; and (D) guide means positioned externally of the enclosure for engaging the outer surface of the outer wall of said enclosure during inflation of the enclosure for controlling deformation of the outer wall in a predetermined manner to form channel means within and along the length of the enclosure to provide flow passages in the enclosure extending from the fluid inlet means to selected distribution points within the enclosure, thereby enabling inflation of the enclosure substantially simultaneously throughout its length.

8. The apparatus as recited in claim 7 wherein said retaining means is external of the enclosure, at least partially enclosing said inflatable enclosure, and said guide means is intermediate the retaining means and the inflatable enclosure.

9. The apparatus as recited in claim 7 wherein said guide means includes spaced parallel projecting means engaging the outer wall of the inflatable enclosure.

10. The apparatus as recited in claim 9 wherein said projecting means comprises substantially parallel rows of tubular elements supported on the retaining means, said channel means being formed within said enclosure between said parallel rows by fluid pressures from said fluid flow.

11. The apparatus as recited in claim 10 wherein said tubular elements in each row are spaced apart longitudinally along said row to provide passageways transverse to said channel means, said outer wall being deformed into said transverse passageways to form transverse channel means.

12. The apparatus as recited in claim 7 wherein said guide means comprises a plate with a surface confronting said outer wall having at least one passage-defining groove in a predetermined configuration so that fluid pressure in the inflatable enclosure deforms the outer wall into the groove to form said channel means.

13. The apparatus as recited in claim 7, wherein said enclosure comprises a tubular body adapted to encircle the extremity.

14. The apparatus as recited in claim 13, wherein said tubular body has a fluid access port positioned substantially midway between its upper and lower ends, said port constituting a common element of said fluid inlet and said fluid outlet means.

15. The apparatus as recited in claim 14, wherein said retaining means comprises a sheath of flexible sheet material having an opening in registry with said port to afford fluid access thereto.

16. The apparatus as recited in claim 7, wherein said enclosure comprises a flat hollow structure adapted to be wrapped around said extremity.

17. The apparatus as recited in claim 16, wherein said retaining means comprises a sheet of flexible material substantially coextensive with said flat structure.

18. The apparatus as recited in claim 17, wherein said enclosure comprises complimentary fasteners for fastening said flat hollow structure around the extremity.

* * * * *